United States Patent [19]

Steinhilber

[11] 4,253,652

[45] Mar. 3, 1981

[54] APPARATUS FOR FEEDING PAPER TO A PRINTING OFFICE MACHINE

[76] Inventor: Helmut Steinhilber, Königstr. 47, D - 7210 Rottweil, Fed. Rep. of Germany

[21] Appl. No.: 29,145

[22] Filed: Apr. 11, 1979

[30] Foreign Application Priority Data

Apr. 15, 1978 [DE] Fed. Rep. of Germany ..... 2816448

[51] Int. Cl.[3] ..... B65H 3/30

[52] U.S. Cl. ..... 271/8 R; 271/22; 271/9; 271/162; 271/160

[58] Field of Search ..... 271/19–22, 271/24, 25, 9, 162, 164, 8, 160

[56] References Cited

U.S. PATENT DOCUMENTS

| | | | |
|---|---|---|---|
| 1,209,110 | 12/1916 | Bradshaw | 271/19 |
| 1,960,482 | 5/1934 | Duncan | 271/22 X |
| 3,285,601 | 11/1966 | Zeuthen | 271/22 |
| 3,517,921 | 6/1970 | Miciukiewicz | 271/8 R |
| 4,108,427 | 8/1978 | Komori | 271/9 |

*Primary Examiner*—Richard A. Schacher
*Attorney, Agent, or Firm*—Blair, Brown & Kreten

[57] ABSTRACT

An apparatus for supplying sheets of paper to the printing platen of an office machine, for example a typewriter or bookkeeping machine. The paper is held in a stack within a removable cassette which can be placed in substantially vertical position into a cassette holder. The cassette is locked in the cassette holder by a slight rearward rotation which causes the engagement of a locking bar with suitable recesses in the cassette. When rotated into the operative position, a spring-loaded pressure plate urges the paper stack against a rotating separating roller which transports the top sheet from the stack in the direction of the printing platen of the office machine. The cassette also includes top sheet separating tabs which hold the corners of the top sheet for a limited time after the separating roller has begun the transport of the sheet, whereafter the top sheet snaps out of position. In order to prevent the weight of the paper stack from interfering with the free movement of the top sheet separating tabs, the lower interior wall of the cassette is raised to form a paper support surface which is advantageously coated with a friction-reducing layer. The mechanism may include provision for holding a second cassette and paper guides for selective admission of sheets from either cassette to the office machine.

7 Claims, 5 Drawing Figures

APPARATUS FOR FEEDING PAPER TO A PRINTING OFFICE MACHINE

FIELD OF THE INVENTION

The invention relates to paper feed mechanisms for office machinery, especially printing office machines, in which the paper is supplied in a removable cassette. The paper cassette may include a spring loaded pressure plate which urges the stack of paper against a pickoff or separating roller which transports the top sheet of the paper stack to the platen of the printing office machine.

BACKGROUND OF THE INVENTION AND STATE-OF-THE-ART

Printing office machines, for example typewriters, bookkeeping machines and the like, are known in which paper is supplied from a stack held in a cassette. The cassette normally contains a pressure plate which is spring-loaded by compression springs situated at its rear side and urges the ream of paper against a driven separating transport roller. The cassette also includes frontal paper handling tabs which are spring-loaded and touch the top of the stack of paper. When the separating roller grasps the top sheet of the stack, the sheet is forced against the corner tabs from which it is forced out by a snap action and thus separated from the rest of the stack for transport to the platen of the office machine.

It is common practice to place the cassette in the apparatus in the horizontal position. In that case, the corner separating mechanisms can be permitted to lie on the top of the paper stack due to their own weight or perhaps aided by a relatively weak spring. The stack of paper is urged upwardly against the separating roller by the spring-loaded pressure plate. The compression spring which provides the upward force is highly compressed at the outset when the cassette contains a full stack of paper and thus its pressure is relatively high. However the pressure exerted by the spring is partially compensated by the weight of the stack of paper which is initially high and decreases as the cassette is being emptied. At the same time, the force of the compression spring decreases so that the paper is pressed against the separating roller with a nearly constant force during the operation of the machine for any degree of filling of the cassette and this kind of constancy is desirable from the point of view of paper transport.

It is a disadvantage of any horizontal cassette holder that the space required for the insertion of the cassette is relatively large.

This disadvantage can be overcome by a vertical cassette position which however entails other problems, for example, the fact that the stack of paper stands substantially vertically on its small edge and rests in the apparatus of the prior art on the lower section of the corner separating mechanisms. The mobility of these corner separators is thus impeded by the relatively high initial weight of the paper stack. In order to insure that the corner separating mechanisms are always reliably in contact with the paper stack in spite of the weight which they have to support, it is generally necessary to provide relatively high spring loading of these mechanisms. However it is a consequence of the relatively high spring forces that when the paper stack decreases in size and thus becomes lighter, the corner separating mechanisms are pressed against the paper stack with great force and thus make the snap-out of the top sheet more difficult. Similarly, the compression spring which urges the pressure plate against the separating roller must be relatively strong so as to insure that the heavy paper stack which rests on the corner mechanisms is pressed sufficiently well against the separating roller. As a consequence, when the cassette is being emptied and the weight of the stack is reduced the entire stack is pushed with great force against the separating roller. This high contact presure makes it difficult to transport the top sheet around the writing platen of the machine and this difficulty tends to cause problems in the line feed mechanism of the typewriter or the like.

The latter difficulty is treated by an improvement disclosed in the German Offenlegungsschrift No. 27 15 649 by an additional mechanism which insures that the pressure plate bears against the paper stack only during the initial pickoff of the top sheet but pivots out of the way when the top sheet of paper is pulled through the machine by the printing platen. Accordingly, the relatively high pressure bearing against the separating roller does not impede the transport of the top sheet of paper by the printing platen. However, the additional mechanism required for the disabling of the pressure plate is relatively complicated both in construction and operation and is subject to malfunctions.

OBJECT AND SUMMARY OF THE INVENTION

It is a principal object of the present invention to provide a paper feed mechanism of the general type described above in which the aforementioned disadvantages are prevented and in which the stack of paper in the cassette as well as the separating roller maintain the same position throughout the paper feeding cycle, i.e., both during the pickoff of the first sheet by the separating roller as well as during the subsequent transport of the top sheet by the printing platen. It is an associated object of the present invention to provide the aforementioned functions without the use of complicated and expensive mechanisms and control systems.

These and other objects are attained according to the invention by providing that the lower side wall of the cassette in the operating position has a raised portion in the interior of the cassette which serves as a rest for the edge of the paper stack. The vertical height of the rest is greater than the vertical extent of the portion of the corner separating mechanisms which are parallel to the side wall of the cassette. The objects of the invention are further advanced by coating the paper rest with a friction-reducing layer, for example a layer of polytetrafluoroethylene.

According to the construction provided by the present invention, the stack of paper makes contact with the coated and friction-reducing paper rest rather than with any part of the movable paper-separating corner mechanisms. Thus the mobility of these corner mechanisms is unimpeded by the presence of the paper stack and a relatively weak spring suffices to keep the corner mechanisms in secure and continuous contact with the paper stack at a pressure which is the optimum pressure for the reliable separation and transport of the top sheet from the stack.

Due to the aforementioned construction, the pressure plate is capable of moving the stack of paper even when it is relatively heavy. Accordingly, the pressure spring used to urge the pressure plate against the separating roller can be a common spring having normal characteristics and will still attain a contact pressure which remains practically constant both for a full as well as a nearly empty cassette. The contact pressure may be so chosen that the separating roller is fully capable of separating the top sheet from the stack and that, at the same time time, the further transport of the paper by the printing platen of the office machine is not impeded by the contact pressure against the separating roller.

Due to the construction according to the present invention, it is expressly possible to permit a constant contact of the paper stack with the separating roller without impeding the progress of the top sheet on the platen which was heretofore impossible as disclosed in the aforementioned publication on page 13, second paragraph. The object is attained furthermore without the necessity of providing extensive and sensitive mechanisms and linkages for pivoting the paper stack away from the separating roller during the transport of the top sheet by the office machine.

In order to prevent contact of the top sheet of paper with the separating roller during insertion of the cassette into its holder, there is provided a guidance which prevents such contact during insertion. As soon as the cassette is fully inserted it is pivoted, rotated and locked in a position in which the separating roller makes contact with the top sheet of the paper stack in the cassette.

The cassette placement according to the invention in the vertical position uses relatively little space and thus permits the placement of a second auxiliary cassette substantially parallel to the first cassette and at some distance behind it. The holding mechanism is equipped with an auxiliary guide foil leading to the printing platen through which paper from this second cassette passes underneath the bottom of the first cassette. If a second cassette is present, it is placed in association with a second separating roller which is drivable independently of the first separating roller. in this manner, it is possible to insert different kinds of paper or forms into the printing office machine alternately or in some other sequence from the two cassettes.

After passage through the office machine, the paper is transported into a suitable paper holder. The presence of the various paper guide mechanisms basically blocks the manual access to the platen of the machine. In order to permit the insertion of an individual sheet of paper not contained in either cassette, there is provided as an advantageous feature of the invention an auxiliary paper chute which permits the manual insertion of individual sheets of paper independently of the automatic transport from either cassette. The insertion of these individual sheets is possible without in any way changing the operating position of the cassette or cassettes.

The construction and function of the paper feed mechanism according to the invention will become clear from a reading of the detailed description of an exemplary embodiment of the invention which follows, and referring to the drawing.

DESCRIPTION OF THE PREFERRED EMBODIMENT

Figure 1:
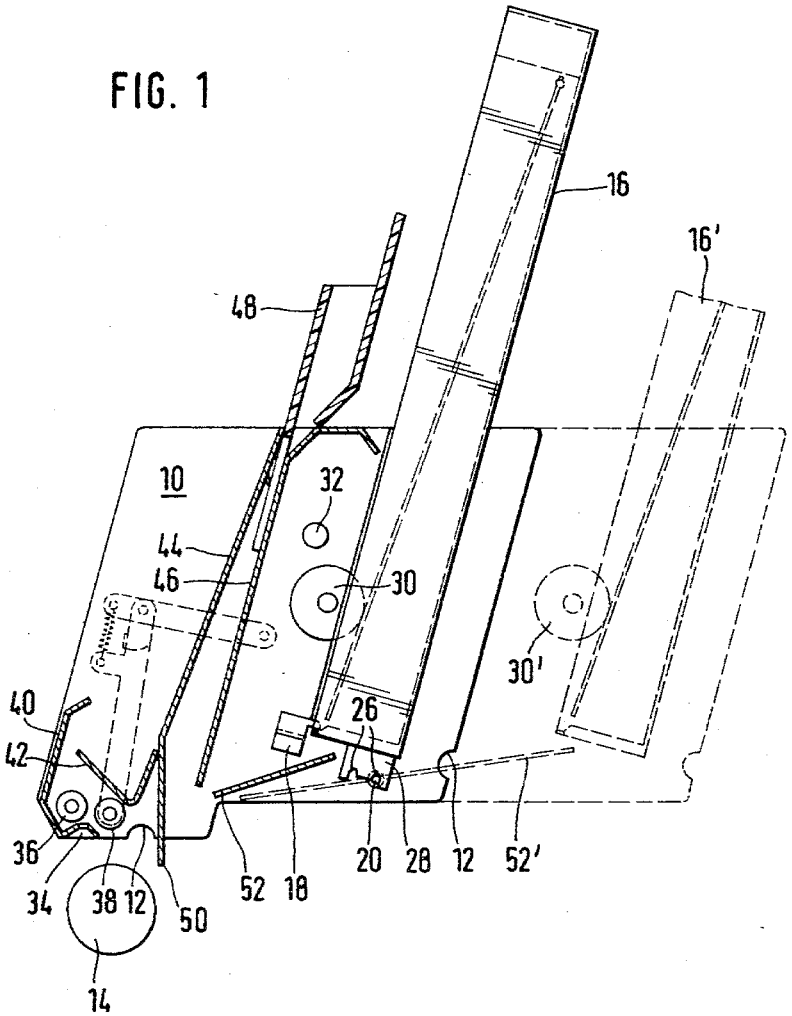
FIG. 1 is a vertical section through an apparatus according to the invention.

As illustrated in FIG. 1, the paper feed mechanism according to the invention includes a housing which consists of lateral walls 10 joined by suitable transverse beams or rods and which has recesses 12 which serve to place and locate it on mating parts, not shown, belonging to an associated office machine, for example a typewriter. The office machine includes a printing platen 14 which is rotatably held in the machine by means not shown.

Figure 2:
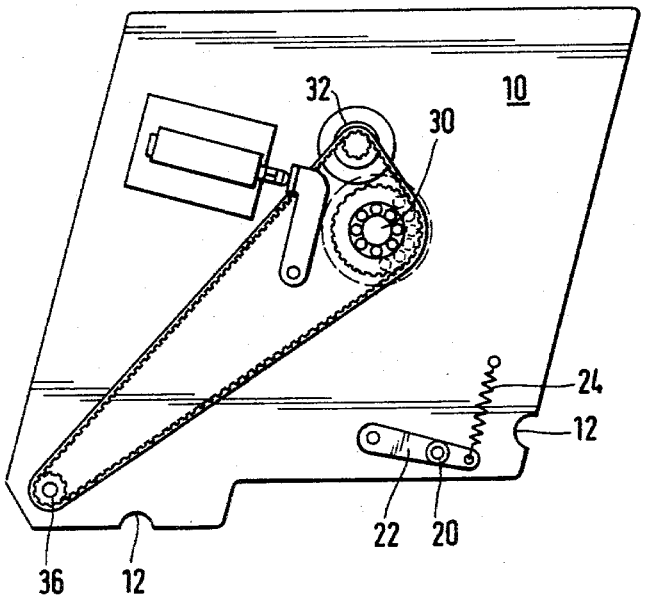
FIG. 2 is a partial side view of the apparatus of FIG. 1.
Figure 4:
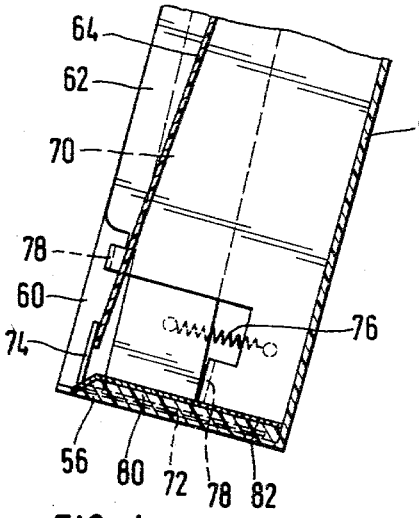
FIG. 4 is an enlarged detailed drawing of the lower portion of the paper cassette.

The side walls 10 of the mechanism include substantially vertically extending guidances which receive and locate a paper storage cassette assembly 16. The cassette 16 which holds a stack of paper which is to be used in the machine is inserted into the mechanism in a substantially vertical position until it is seated and is thereafter rotated through a small angle in the clockwise sense so as to assume the position illustrated in FIG. 1. In that position, the lower side wall of the cassette engages two locking bosses 18 which prevent a further clockwise rotation of the cassette as well as any upward movement thereof. A locking bar 20 is pivotably attached to the side walls 10 on arms 22, as best seen in FIG. 2, and is urged by springs 24 to engage the rearmost of two notches 26 in a latch plate 28 which extends downwardly from the side wall of the cassette 16. The locking bar 20 also acts to prevent a counterclockwise motion of the cassette 16 and cooperates with the bosses 18 to hold the cassette firmly in the position illustrated in FIG. 1. The cassette may be easily removed from the holder by applying a slight counterclockwise torque at its upper edge which causes the locking bar 20 to move from the rear notch 26 to the front notch 26 in which position the cassette is released from the locking bosses 18 and may be freely lifted from the apparatus.

During the insertion and removal of the cassette 16 from the mechanism, it is guided so as to prevent contact of the paper stack with a rotatably and drivably mounted pickoff or separating roller 30. However, when the cassette 16 has been pivoted and ratcheted in the operative position illustrated in FIG. 1, the paper stack is pressed against the separating roller 30.

The separating roller 30 is driven by a suitable electric motor 32 via transmission means, not shown. In operation, it is the purpose of the separating roller 30 to slide the topmost sheet of paper from the stack in the cassette 16 and to transport it into the operating region of the printing platen 14 of the office machine.

After bering imprinted, the paper is transported by the platen 14 upwardly through a slotted funnel 34 to pass between a pair of rollers 36 and 38. The transport roller 36 may also be driven by the motor 32 whereas the roller 38 is a counterroller and idles freely while being pressed against the roller 36.

The transport rollers 36 and 38 move the imprinted sheet upwardly where it is placed by a guide foil 40 into a substantially vertical position into a paper holder located in front of the cassette 16. The paper holder consists of a lower and angled support foil 42 and a substantially vertical rear wall 44.

Located behind the rear wall 44 and substantially parallel thereto is a further guide foil 46 whose upper end is bent rearwardly, thereby forming an upwardly enlarging funnel together with the rear wall 44. This funnel can be used to receive a larger insertion funnel 48 of somewhat greater width.

At the bottom end, the rear wall 44 extends downwardly beyond the holding foil 42 and is also bent rearwardly slightly. The rearwardly bent end 50 of the wall 44 cooperates with the guide foil 46 to define a tapered channel in the direction of the printing platen 14.

A further guide foil 52 cooperates with the guide foil 46 to define a tapering supply funnel for guiding the paper from the cassette 16 to the platen 14.

As illustrated in FIG. 1 in dashed lines, it is optionally possible to prolong the side walls 10 rearwardly and to include guide means for locating and holding a second cassette 16', substantially parallel to the cassette 16. Associated with the second cassette 16' is a separating roller 30' which is rotatable independently of the roller 30. In order to guide the paper from the cassette 16' to the platen 14, a guide foil 52' is disposed underneath the cassette 16' and extends below the first cassette 16 and the guide foil 52 in the direction of the printing platen 14. The presence of the second cassette 16' makes possible the selective admission of sheets of paper from either cassette.

Figure 3:
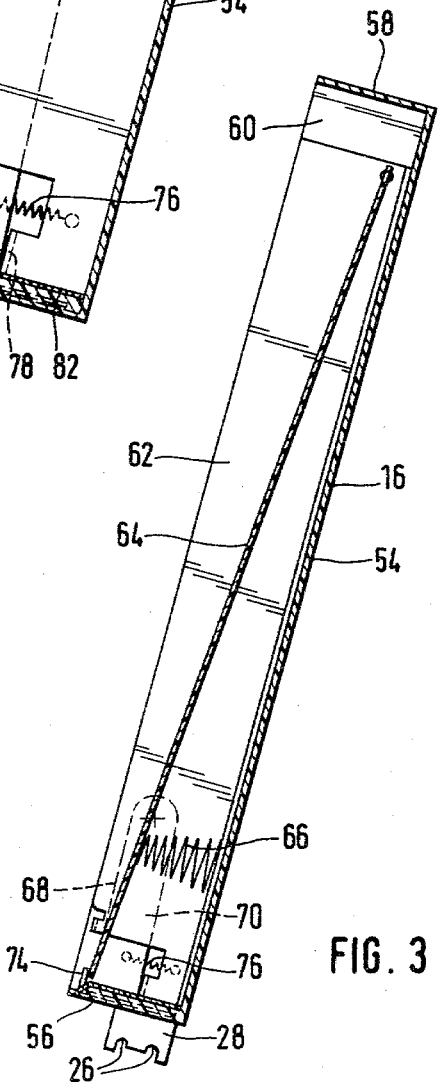
FIG. 3 is a sectional view of a cassette for use with the mechanism of FIG. 1.
Figure 5:
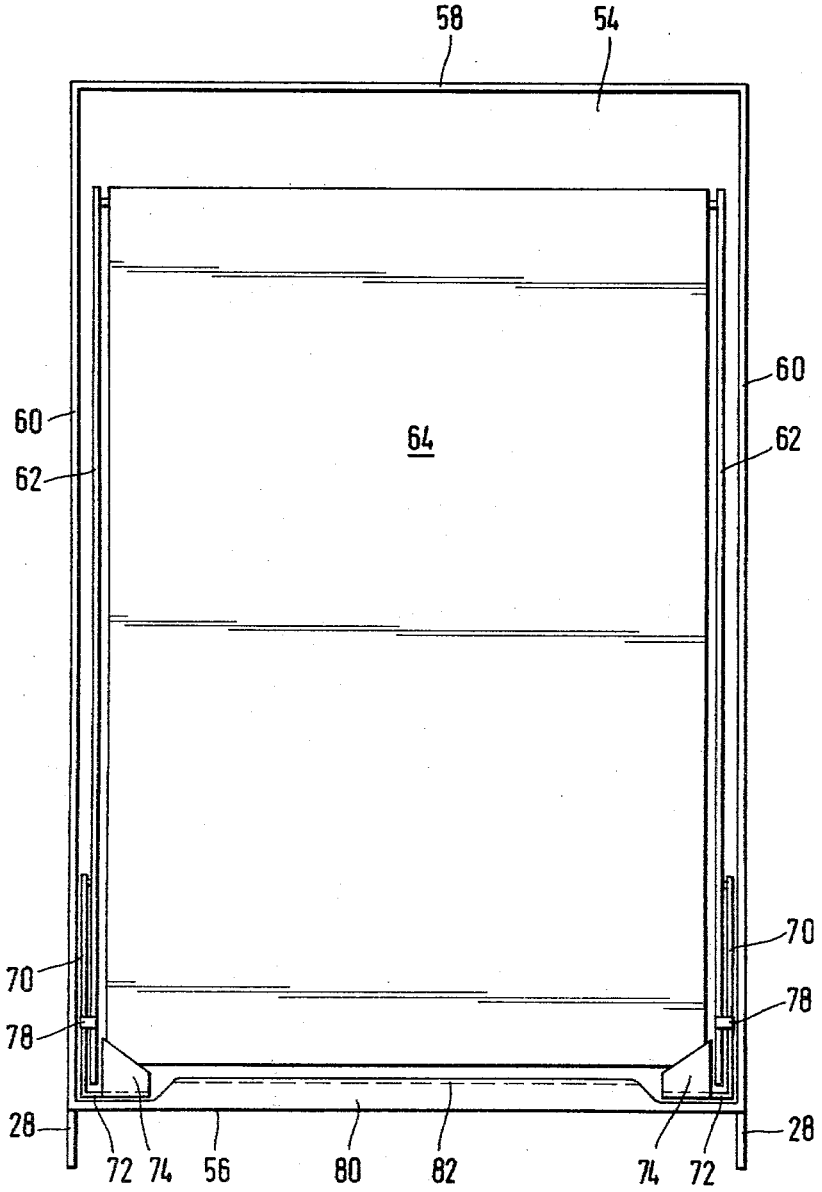
FIG. 5 is a front view of the cassette of FIG. 3.

The detailed construction of the cassette 16 or 16' is illustrated in FIG. 3 and FIG. 5 and is seen to include a substantially rectangular box-like housing open on one large side, and may be constructed, for example, of plastic. The housing defines a bottom 54 and side walls 56, 58 and 60.

Paper guiding walls 62 are inserted in the cassette substantially parallel to the side wall 60 for lateral contact with the paper stack. A pressure plate 64 is pivotably attached to the top ends of the guide walls 62 in the vicinity of the bottom plate 54. The pressure plate 64 is urged into contact to the rear of the stack of paper (not shown) and is pressed against it by the force exerted by a spring 66 which may be inserted as shown in the vicinity of the freely pivoting end of the pressure plate 64 between the pressure plate and the bottom plate 54.

The cassette is equipped with two lateral paper corner separating mechanisms 68 attached to the lateral guide walls 62. The corner separators 68 include a foil strip 70 which makes contact with and is pivotably attached to the guide walls 62 and which extends beyond the lower end of the guide walls 62 where it is bent inwardly to define a section 72 which extends parallel to the lower side wall 56. At the edge nearest the open side of the cassette, the strip 72 is angled over to form a corner 74 which extends over the lower corners of the paper stack. A tensile spring 76 disposed between the foil 70 and the guide walls 62 holds the corner 74 in positive elastic contact with the paper stack, not shown. Tabs 78 bent outwardly from the guide walls 62 limit the pivotal motion of the paper-separating tabs 68. The pivotal motion of the pressure plate 64 is limited by the aforementioned angled corner 74 of the paper separating tab mechanism 68.

It is a significant feature of the present invention that the lower side wall 56 of the cassette 16 is increased in thickness between the bent-over portion 72 of the paper separating tabs 68, thereby defining a paper rest or paper support surface 80. The vertical extent of the paper support 80 is such as to extend inwardly beyond the bent-over region 72 of the paper separating tabs 68. Accordingly, the paper stack within the cassette 16 rests on the support 80 rather than on the bent-over section 72 of the separating tabs 68. In this manner, the freedom of those separating tabs 68 to pivot is unimpeded by the weight of the paper stack. Advantageously, the paper support 80 is coated on its top surface with a friction-reducing layer 82 consisting of, for example, polytetrafluoroethylene. Such a layer permits the easy shifting of the paper stack on the support 80 by the force exerted by the pressure plate 64.

The paper supply mechanism according to the invention and as described above operates in the following manner:

The cassette 16 is loaded by placing therein a stack of paper in such a manner that the pressure plate 64 urges the stack forwardly, and causing its lower corners to be held in place by the bent-over corners 74 of the separating tabs 68. The cassette is then inserted into the apparatus in a substantially vertical position and the guides on the side walls 10 prevent any contact of the top sheet of paper with the separating roller 30. When the cassette is fully inserted, it is pivoted rearwardly, i.e., in the clockwise sense as shown in FIG. 1, until the locking bosses 18 engage the cassette housing and the locking bar 20 is seated in the rearward recess 26. In this position, the stack of paper is urged against the separating roller 30 by the pressure plate 64 and the corners 74 of the separating tabs 68 are in contact with the top sheet of the stack under the influence of the spring 76.

A second cassette 16' is inserted in the identical manner.

At this point it is possible to rotate the separating roller 30 (30'), which transports the top sheet of the stack downwardly causing the bottom corners of the sheet of paper to snap out of the holding corners 74, thereby causing its separation from the remaining stack of paper whereafter it is transported through the guide foil 52 or 52' to the printing platen 14 which then assumes the further transport of the sheet.

If it is desired to feed to the platen 14 an individual sheet not contained in the cassette 16 or 16', such a sheet may be inserted manually into the auxiliary chute formed by the rear wall 44 of the paper holder and the guide foil 46, possibly with the aid of the removable funnel 48.

After being imprinted, the transport rollers 36 and 38 guide the paper into position in the paper storage holders 42, 44.

The foregoing illustrative example is provided as a non-limiting embodiment of the invention and numerous variants thereof are possible within the spirit and scope of the invention.

I claim:

1. An apparatus for feeding sheets of paper to the platen of a printing office machine, said apparatus including a cassette holder for locating and holding a cassette containing a stack of sheets of paper in a substantially vertical position, and said apparatus further including at least one drivable separating roller for engaging and transporting the top sheet of paper in said stack of sheets of paper in said cassette, said cassette including a spring-loaded pressure plate for urging said stack into the direction of said separating roller when said cassette is in its operating position in said cassette holder and said cassette being further provided with a top sheet separating mechanism including spring-loaded top sheet separating tabs which engage the top sheet of said stack and said apparatus being further provided with paper-guide channels for guiding said top sheet into operative engagement with the printing platen of said office machine and a paper holder for holding imprinted sheets of paper and wherein said cassette has a lower side wall when placed in the operative position in said cassette holder, said lower side wall defining an inwardly projecting paper support surface for supporting the lower edges of said sheets of paper in said stack, the vertical extent of said support surface being greater than the vertical extent of portions of said top sheet separating tabs which are parallel to said lower side wall.

2. An apparatus according to claim 1, wherein said support surface is coated with a friction-reducing coating.

3. An apparatus according to claim 2, wherein said friction reducing coating is a coating of polytetrafluoroethylene.

4. An apparatus according to claim 1, wherein said cassette holder includes means for so positioning said cassette that said separating roller makes continuous contact with the top sheet of said paper stack in the operative position of said cassette.

5. An apparatus according to claim 4, wherein said cassette holder includes cassette guide means and cassette locking means permitting insertion of said cassette into said cassette holder without contact between said separating roller and said paper stack and further permitting limited pivoting of said cassette to cause elastic engagement of said separating roller and said paper stack.

6. An apparatus according to claim 1, wherein said paper holder has a rear wall cooperating with a guide foil to define an auxiliary paper guiding chute for providing manual access to said printing platen of said office machine for insertion of individual sheets of paper.

7. An apparatus according to claim 1, wherein said cassette holder comprises means for locating and holding a second cassette in substantially parallel position with respect to said cassette and still further includes secondary paper guide channels for guiding the top sheet of said second cassette into operative engagement with the printing platen of said office machine, said second guide channel extending below said cassette and said apparatus including a second separating roller which is drivable independently of said separating roller.

* * * * *